US005724923A

United States Patent [19]

Green

[11] Patent Number: 5,724,923

[45] Date of Patent: Mar. 10, 1998

[54] REFRACTORY SHIELD DESIGN FOR SUPERHEATER TUBES

[75] Inventor: Kenneth E. Green, Auburn, Mass.

[73] Assignee: Saint-Gobain/Norton Industrial Ceramics Corp., Worcester, Mass.

[21] Appl. No.: 445,437

[22] Filed: May 19, 1995

[51] Int. Cl.[6] ..... F22B 37/06; F27D 37/10

[52] U.S. Cl. ..... 122/511; 122/DIG. 13; 122/510; 138/162

[58] Field of Search ..... 122/510, 511, 122/DIG. 13, 493, 495; 138/156, 162, 166, 167, 168, 110

[56] References Cited

U.S. PATENT DOCUMENTS

| | | | |
|---|---|---|---|
| 3,914,100 | 10/1975 | Guskea | 432/234 |
| 4,100,889 | 7/1978 | Chayes | 122/510 |
| 4,337,034 | 6/1982 | Morgan, II et al. | 432/234 |
| 4,944,254 | 7/1990 | Fournier et al. | 122/511 |
| 5,154,648 | 10/1992 | Buckshaw | 122/DIG. 13 |
| 5,220,957 | 6/1993 | Hance | 122/DIG. 13 |
| 5,458,155 | 10/1995 | Stephens | 138/162 |
| 5,511,609 | 4/1996 | Tyler | 122/DIG. 13 |

FOREIGN PATENT DOCUMENTS

| | | | |
|---|---|---|---|
| 0 272 579 | 6/1988 | European Pat. Off. | F22G 3/00 |
| 636392 | 4/1928 | France . | |
| 407295 | 12/1924 | Germany . | |

*Primary Examiner*—Henry A. Bennett
*Assistant Examiner*—Jiping Lu
*Attorney, Agent, or Firm*—Thomas M. DiMauro

[57] ABSTRACT

The present invention relates to a refractory shield for protecting a superheater tube against fluid attack comprising first and second partial-tubes, each partial-tube having a C-shaped cross-section, the C-shaped cross section defining first and second ends; wherein the ends of the partial-tubes are opposably engaged, and wherein the partial-tubes comprise means for preventing radial movement of the first partial-tube relative to the second partial-tube.

8 Claims, 2 Drawing Sheets

REFRACTORY SHIELD DESIGN FOR SUPERHEATER TUBES

BACKGROUND OF THE INVENTION

The high cost of energy has led industry to extract usable heat from high temperature waste streams whenever practical. In some applications, a heated waste stream passes over conventional crossflow metallic heat exchanger tubes containing clean ambient air. The ambient air is heated by the waste stream and then typically used as either facility or process heat. In other applications, such as municipal solid waste incineration in which trash and garbage are incinerated to form gaseous products at temperatures up to 2500° F., water is passed through metallic tubes ("superheater tubes") positioned within the gaseous product stream and converted to steam by the high temperatures. The steam produced by the tube assembly is then used to power a turbine-driven electrical generator.

Although heat extraction from high temperature waste streams using metal-tubed heat exchangers is efficient, two particular problems with metal tubes have been observed. First, the temperature limits of the metals are frequently exceeded by the operating temperatures of the heat exchangers. Second, waste streams are frequently abrasive and/or corrosive and so threaten the physical integrity of the metallic tubes.

To prevent direct attack of the tubes by the products of combustion while allowing the tubes to be superheated, the art has used refractory ceramic shields to cloak the tubes. The refractoriness of these shields provides for high thermal conductivity, integrity at high temperatures, erosion resistance and corrosion resistance. For example, U.S. Pat. No. 4,682,568 discloses a refractory shield comprising a pair of refractory half-shields of identical interchangeable interlocking size and shape, including an interlocking tongue and groove feature ("tongue and groove shields"). See FIG. 1. This design is assembled by applying mortar M to either the superheater tube S or the inner surfaces of the half-shields, attaching one of the half-shields to the outer surface of the superheater tube, positioning the second partial-tube 180 degrees thereto to align the tongues T and the grooves G, and axially engaging the half-shields. This process is repeated until the exterior of each superheater tube is covered. However, this design possesses two drawbacks. First, it requires a clamping mechanism to hold the shields together until the mortar bonds the shields to the tube. Second, the tongue and groove shields may fall off the metallic heat exchanger tubes under extreme service conditions.

Accordingly, there is a need for a refractory tube shield which will not fall from the metallic heat exchanger tube during operation in severe environments.

SUMMARY OF THE INVENTION

In accordance with the present invention, there is provided a refractory shield for protecting a superheater tube against environmental attack, comprising first and second partial-tubes, each partial-tube having a C-shaped cross-section, the C-shaped cross section defining first and second ends; wherein the ends of the first partial-tube oppose the ends of the second partial-tube, and wherein the partial-tubes comprise means for preventing radial movement of the first partial-tube relative to the second partial-tube.

In an especially preferred embodiment, as shown in FIG. 2, there is provided a refractory shield for protecting a superheater tube against environmental attack, comprising:

a) a first partial-tube having a C-shaped cross section, the C-shaped cross section having first and second ends, each end comprising an outer radial portion and an inner radial portion, each outer radial portion extending farther than each inner radial portion to define a seat at the terminus of each inner radial portion, each outer radial portion terminating in a tip;

b) a second partial-tube having a C-shaped cross section, the C-shaped cross section terminating in first and second tips;

wherein the tips of the second partial-tube oppose the seats of the first partial-tube, and the distance between the tips of the second partial-tube is greater than the distance between the tips of the first partial-tube.

DETAILED DESCRIPTION OF THE INVENTION

For the purposes of the present invention, "radial movement" is considered to be perpendicular movement toward or away from the surface of the superheater tube which results in the disengagement of the half-shields.

Without wishing to be tied to a theory, it is believed that the weakness of the design disclosed in U.S. Pat. No. 4,682,568 stemmed from its reliance on the mortar layer exerting enough pressure on the shields to activate the tongue and groove locking mechanism. In particular, it is believed the mortar could dry and shrink in use, creating a space between the tube and the interlocked half-shields. Under extreme circumstances, the interlocked half-shields could radially shift relative to each other, unlock and ultimately fall from the tube when exposed to the high speed gases of the boiler. The present invention solves the problem faced by the tongue-and-groove design by providing a lock independent of the mortar's ability to provide a tight fit between its half-shields.

Figure 2:
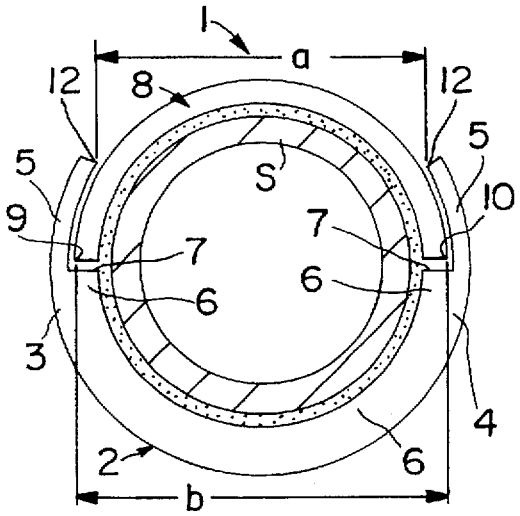

Referring now to FIG. 2, there is provided in an especially preferred embodiment a refractory shield 1 for protecting a superheater tube S against environmental attack, comprising:

a) a first partial-tube 2 having a C-shaped cross section, the C-section having first and second ends 3 and 4, each end comprising an outer radial portion 5 and an inner radial portion 6, each outer radial portion 5 extending in a concave arc of at least about 10° farther than each inner radial portion to define a seat 7 at the terminus of each inner radial portion 6, each outer radial portion 5 terminating in a tip 12;

b) a second partial-tube 8 having a C-shaped cross section, the C-shaped cross section terminating in first and second tips 9 and 10;

wherein the tips 9 and 10 of the second partial-tube 2 oppose the seats 7 of the first partial-tube 2, and the distance between the tips 9 and 10 of the second partial-tube 8 ("b" in FIG. 2) is greater than the distance between the tips 12 of the first partial-tube 2 ("a" in FIG. 2).

In the preferred embodiment shown in FIG. 2, there is a gap between the tips 9 and 10 of the second partial-tube 8 and the opposing seats 7 of the first partial-tube 2. However, this gap is so small that the second partial-tube 8 is prevented from peripherally rotating more than a few degrees in either direction. Typically, the gap is filled in with mortar. In service, this gap is often between about 1/32 and 1/4 inches, typically about 1/16 inch.

The embodiment shown in FIG. 2 prevents the second partial-tube 8 from radially shifting (i.e., falling off) by requiring the distance between the tips of the second partial-tube to be greater than the distance between the tips of the first partial-tube. This condition is accomplished by a) aligning the tips of the second partial-tube to oppose the seats of the first partial-tube, and b) extending in a concave curve each outer radial portion of the first partial-tube between about 10° and about 50° farther than the inner radial portion, preferably about 37°. Preferably, the distance between the tips of the second partial-tube 8 is at least 10% greater than the distance between the tips of the first partial-tube 2. More preferably, the distance between the tips of the second partial-tube is at least 20% greater than the distance between the tips of the first partial-tube.

Since the partial-tubes are made of a rigid refractory, the second partial-tube will not bend through the open space between the tips 12 of the first partial-tube 2.

Figure 1:
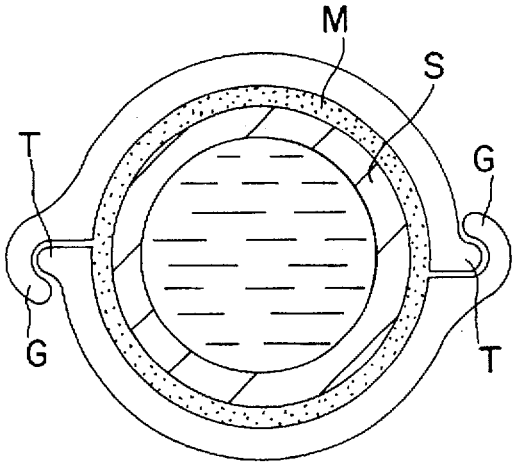
FIG. 1 PRIOR ART
FIG. 1 is a radial cross section of a prior art shield design fitted to a superheater tube.
Figure 3:
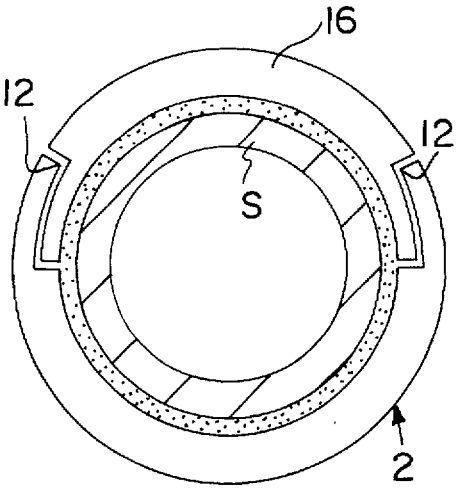
FIGS. 2–6 are radial cross sections of shields of the present invention fitted to a superheater tube.

The design of FIG. 2 also provides a relatively smooth silhouette, thereby providing little hydrodynamic interference for the boiler gases. If desired, the second partial-tube 8 may also feature a central raised outer radial portion 16 to provide an even more smooth silhouette, as shown in FIG. 3.

In addition, assembly of the shield of FIG. 2 does not require the use of clamps. Rather, the shield can be fitted to the superheater tube by first applying a wet mortar to the entire circumference of the superheater tube, sliding the first partial- tube 2 along the superheater tube to its service position, and sliding the second partial-tube 8 into the opening defined by the superheater tube, the seats 7 and the inner surfaces 11 of the outer portions 5 of the first partial-tube 2, thereby shielding the entire circumference of the superheater tube from harmful boiler gases.

Figure 4:
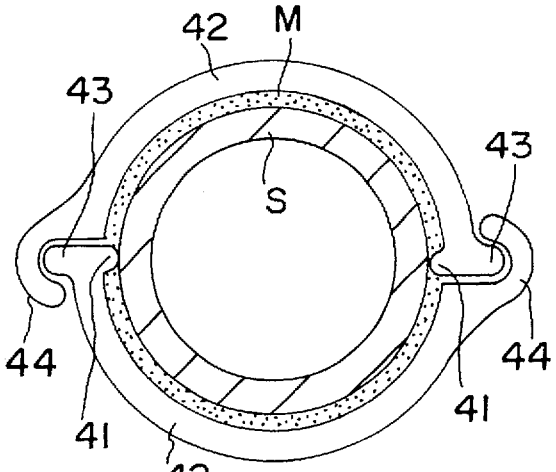
Figure 5:
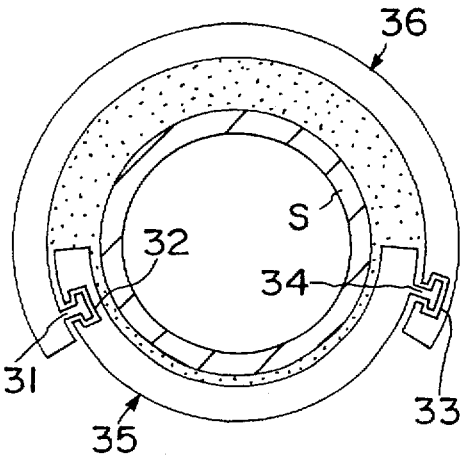
Figure 6:
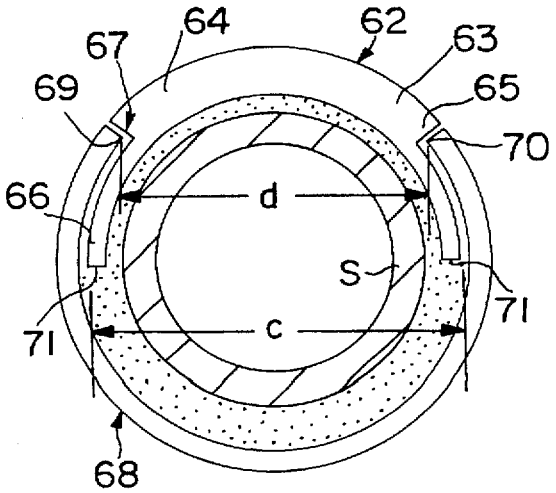

In some preferred embodiments of the invention, the means for preventing radial movement comprises one of:

a) an axial projection extending from the inner surface of each partial-tube to contact the superheater tube, as in FIG. 4;

b) an axial "T"-shaped projection extending radially from the surface of the first partial-tube towards the second partial-tube, and an axial groove extending into the surface of the second partial-tube for axially receiving the "T"-shaped projection therein, as in FIG. 5; or c) a seat/tip assembly wherein the seat resides on the outer radial portion of the shorter partial-tube, as in FIG. 6.

Referring now to FIG. 4, in another embodiment of the present invention, there is provided the superheater shield as shown in U.S. Pat. No. 4,682,568 modified by an axial projection 41 extending from the inner surface of each partial-tube opposite its tongue 43 to contact the superheater tube. As shown in FIG. 4, radial displacement of bottom partial-tube 42 is prevented by the projection 41 bearing on the tube S and by the tongue 43 bearing on the groove 44.

Referring now to FIG. 5, there is provided T-shaped projections 31 and 34 extending radially from a partial-tube surface towards the opposing partial-tube surface, and grooves 32 and 33 extending into the surface of the opposing partial-tube for axially receiving the T-shaped projection therein. The T-shaped projection may extend toward or away from the superheater tube. As shown in FIG. 5, all radial movement is prevented by the securing lock formed when T-shaped projections 31 and 34 are received in grooves 32 and 33.

Referring now to FIG. 6, there is provided a variation on the seat/opposing tip concept developed in FIG. 2, wherein the seat is formed on the outer radial portion of the shorter partial-tube. In FIG. 6, the shield comprises:

a) a first partial-tube 62 having a C-shaped cross section, the C-section having first and second ends 63 and 64, each end comprising an outer radial portion 65 and an inner radial portion 66, each inner radial portion 66 extending in a concave arc of at least about 10° farther than each outer radial portion 65 to define a seat 67 at the terminus of the outer radial portion 65, each inner radial portion 66 terminating in a tip 71;

b) a second partial-tube 68 having a C-shaped cross section, the C-shaped cross section terminating in first and second tips 69 and 70;

wherein the tips 69 and 70 of the second partial-tube 68 oppose the seats 67 of the first partial-tube 62, and the distance between the tips 71 of the first partial-tube 62 ("c" in FIG. 6) is greater than the distance between the tips 69 and 70 of the second partial-tube 68 ("d" in FIG. 6). Peripheral movement is prevented by the seat/opposing tip interface while radial movement is prevented by the rigid inner radial portion 66 of the first partial-tube bearing against the rigid inner surface of the tip 69 and 70 of the second partial-tube 68.

While the designs of FIGS. 2–6 disclose different partial-tube locking features providing different advantages in different heat exchanger designs, each nonetheless includes the commonality of a means for preventing the relative radial movement of one partial-tube vis-a-vis its opposing partial-tube. Accordingly, the scope of the present invention comprises superheater tube shield designs which preclude radial movement of the partial-tubes without relying on either mortar or clamps.

Figure 7:
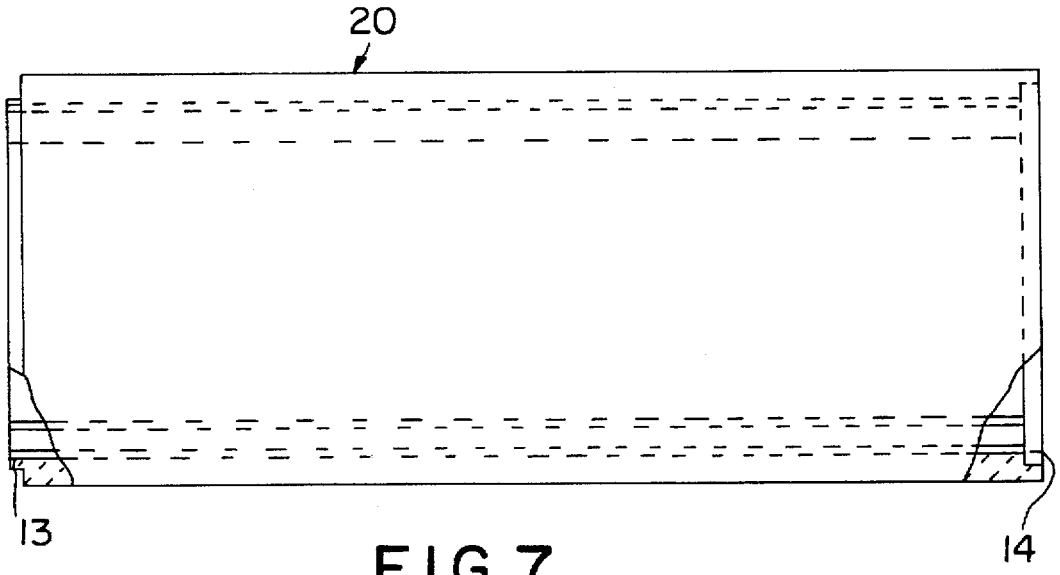
FIG. 7 is an axial view of a preferred embodiment of the present invention.

If the superheater tube is of such length as to require a second shield, mortar may be applied to the axial ends of the in-place shield to provide a secure bond between the first and second shields when the second shield is set next to the first shield. In one preferred embodiment involving multiple shields, each shield 20 features a circumferential lip 13 on one axial end and a corresponding circumferential groove 14 on its other axial end. See FIG. 7. In this embodiment, the lip of a first shield is slid over the groove of the second shield, thereby forming a tortuous path from the outside of the shield to the superheater tube surface. This tortuous path makes it harder for the harmful boiler gases to reach the superheater tube surface, especially if the path is filled with mortar.

The shields of the present invention may be made of any refractory material typically used as a superheater tube shield, including silicon carbide, alumina, zirconia, magnesia, chromia and mixtures thereof. In preferred embodiments, the shields are made from a nitride bonded silicon carbide whose silicon carbide component is made from mixing 30 weight percent ("w/o") of 30–90 mesh green silicon carbide, 17 w/o of −100 mesh green silicon carbide, 35 w/o of 3 micron silicon carbide and 18 w/o of −200 mesh silicon metal powder. This mixture is then mixed with 12 w/o water and 0.75 w/o sodium silicate deflocculant until it attains a viscosity suitable for slip casting in a porous mold of the desired shape. The slip is then slip cast in substantial accordance with U.S. Pat. No. 2,964,823, the specification of which is incorporated by reference, and then removed from the mold. The green slip cast shape is then further dried and fired at about 1450° C. in a nitrogen atmosphere until cured. In some embodiments, the shield is made from CRYSTON (TM), available from the Norton Company of Worcester, Mass.

Any mortar commonly used in bonding tube shields to superheater tubes may be used. Preferably, a silicon carbide-based mortar containing silica, alumina and alkalies is used. More preferably, CRYSTOLON MC-1063, available from the Norton Company Refractory Systems of Worcester, Mass. is used.

Although the embodiments of the present invention are designed for essentially cylindrical superheater tubes, it is contemplated that the present invention would also work for other superheater tube designs having non-circular cross-sections, such as ovals and ellipses.

Typically, the superheater tube has a circular outside diameter of between 5 and 8 cm, preferably about 6.4 cm. In preferred embodiments such as FIG. 2, the first partial-tube has an outer diameter of between 8.3 and 10.8 cm, preferably about 9.6 cm; an inner diameter of between about 5.7 and about 8.3 cm, preferably about 6.9 cm; a seat extending radially outward from the inner diameter between 1.2 and 1.4 cm, preferably about 1.2 cm; and an outer radial portion which extends concavely between about 10° and about 50° past its inner portion, preferably about 37° degrees.

Although the present invention is desirably used on superheater tubes having an outer diameter only slightly smaller than the partial-tubes' inner diameter, it may also be retrofit on much smaller superheater tubes provided that larger-than-normal amounts of mortar are applied during installation.

Although the present invention was designed for specific use with superheater tubes in boiler applications, it is contemplated that the above design may also be advantageously used in other heat exchanger applications such as floor tubes, bypass tubes, or any tubes subject to abrasive or corrosive conditions.

I claim:

1. A refractory shield for protecting a superheater tube against environmental attack, comprising:

a) a first partial-tube having a C-shaped cross section, the C-shaped cross section having first and second ends, each end comprising an outer radial portion and an inner radial portion, each outer radial portion having a concave inner surface and extending farther than each inner radial portion to define a seat at the terminus of each inner radial portion, to define a seat at the terminus of each inner radial portion, each outer radial portion terminating in an end having an inner tip;

b) a second partial-tube having a C-shaped cross section, the C-shaped cross section terminating in first and second ends, each end having an outer tip;

wherein the ends of the second partial-tube oppose the seats of the first partial-tube, each end of the second partial tube has a convex outer surface corresponding to the concave inner surface of the corresponding outer radial portion of the first partial tube, and the distance between the outer tips of the second partial-tube is greater than the distance between the inner tips of the first partial-tube, and wherein the refractory is selected from the group consisting of silicon carbide, alumina, zirconia, magnesia, chromia, and mixtures thereof.

2. The shield of claim 1 wherein each outer radial portion of the first partial-tube concavely extends between about 10° and about 50° farther than its inner radial portion.

3. The shield of claim 2 wherein each outer radial portion of the first partial-tube concavely extends about 37° farther than its inner radial portion.

4. The shield of claim 2 wherein the distance between the outer tips of the second partial-tube is at least 20% greater than the distance between the inner tips of the first partial-tube.

5. The shield of claim 1 wherein the distance between the outer tips of the second partial-tube is at least 10% greater than the distance between the inner tips of the first partial-tube.

6. The shield of claim 1 wherein the first and second ends of the second partial-tube oppose the seats of the first partial-tube at a distance of between about 1/32 inches and 1/4 inches.

7. The shield of claim 1 wherein the first and second ends of the second partial-tube oppose the seats of the first partial-tube at a distance of about 1/16 inch.

8. The shield of claim 1 consisting of the first and second partial tubes.

* * * * *